US006342105B1

(12) United States Patent
Yano et al.

(10) Patent No.: US 6,342,105 B1
(45) **Date of Patent: *Jan. 29, 2002**

(54) WASHING SOLUTION FOR INK JET HEAD, METHOD FOR PRODUCING THE SAME, AND METHOD FOR WASHING INK JET HEAD USING THE SAME

(75) Inventors: Toshiyuki Yano; Hiromi Nagai; Ken Hashimoto; Naoki Morita, all of Minami-Ashigara (JP)

(73) Assignee: Fuji Xerox Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/191,540

(22) Filed: Nov. 13, 1998

(30) Foreign Application Priority Data

Nov. 21, 1997 (JP) ..... 9-321722
Nov. 28, 1997 (JP) ..... 9-328933

(51) Int. Cl.[7] ..... B08B 3/08; B41J 2/165

(52) U.S. Cl. ..... 134/42; 510/170; 510/405; 510/421; 510/432; 347/22; 347/28

(58) Field of Search ..... 510/170, 405, 510/421, 432; 134/42; 347/22, 28

(56) References Cited

U.S. PATENT DOCUMENTS 4,256,610 A * 3/1981 Hwang ..... 510/170
4,655,909 A * 4/1987 Furuno ..... 210/90
4,769,170 A * 9/1988 Omori et al. ..... 510/170
4,829,897 A * 5/1989 Wyman et al. ..... 101/483
5,347,713 A * 9/1994 Shibata et al. ..... 29/890.1
5,605,881 A * 2/1997 Machida et al. ..... 510/166
5,786,829 A * 7/1998 Pasciak, Jr. et al. ..... 347/28
5,825,380 A * 10/1998 Ichizawa et al. ..... 347/28
5,917,512 A * 6/1999 Weber et al. ..... 347/28
5,954,891 A * 9/1999 Kondoh et al. ..... 134/40
6,086,191 A * 7/2000 Yano et al. ..... 347/85

FOREIGN PATENT DOCUMENTS

| | | | |
|---|---|---|---|
| JP | A-58-71170 | | 4/1983 |
| JP | A-60-139454 | | 7/1985 |
| JP | 61101292 | * | 5/1986 |
| JP | A-61-144357 | | 7/1986 |
| JP | 62169876 | * | 7/1987 |
| JP | A-4-115954 | | 4/1992 |
| JP | A-6-8461 | | 1/1994 |
| JP | A-6-8471 | | 1/1994 |
| JP | A-8-310011 | | 11/1996 |
| JP | A-9-39260 | | 2/1997 |
| JP | A-63-260451 | | 10/1998 |

* cited by examiner

*Primary Examiner*—Lorna M. Douyon
(74) *Attorney, Agent, or Firm*—Oliff & Berridge, PLC

(57) ABSTRACT

There are provided a washing solution for an ink jet head, the washing solution restoring a print head, which has experienced problems such as clogging, to its normal condition, a method for producing the washing solution, and a washing method. The washing solution comprises 80% by weight or more of water and 1.0% by weight or less of a substance (having a viscosity of 10 mPas or more at 25° C.) and/or a solid substance and has a viscosity between 0.6 and 3.0 mPas at 25° C. and an electroconductivity of $3\times10^{-2}$ S/m or less at 25° C.

13 Claims, 9 Drawing Sheets

WASHING SOLUTION FOR INK JET HEAD, METHOD FOR PRODUCING THE SAME, AND METHOD FOR WASHING INK JET HEAD USING THE SAME

BACKGROUND OF THE INVENTION

1. Field of the Invention

The present invention relates to a washing solution for washing an ink jet head of art ink jet recording device, to a method for producing the washing solution, and to a method for washing an ink jet head using the washing solution.

2. Description of the Related Art

The principle behind the ink jet recording method is to jet either liquid or molten solid ink from a nozzle, slit, porous film, or the like so as to perform a recording on paper, cloth, film, or the like. Various methods are proposed for jetting ink. These methods include a so-called charge control method of jetting ink. by making use of electrostatic induction force, a so-called drop-on-demand pressure pulse method of jetting ink by making use of the vibration pressure of a piezoelectric element, and a so-called thermal ink jet method of jetting ink by making use of the pressure produced by forming and growing air-bubbles under high temperatures. An extremely fine image can be produced by these methods.

Well-known inks used in the ink jet recording method include aqueous dye inks produced by dissolving various aqueous dyes in a liquid medium composed of water and an aqueous organic medium, aqueous pigment inks produced by dispersing various pigments in a liquid medium composed of water and an aqueous organic medium, and oil dye inks produced by dissolving an oil-soluble dye in an organic medium. Among these inks, the aqueous ink is highly safe because its major medium is water and is hence the dominant ink used in ink jet recording.

In order to use such an aqueous ink for ink jet recording, if it is stored in an ink jet recording head, the ink must have the characteristics that it is stably held in the head in the liquid form and it prevents clogging caused by drying, changes in ink compositions caused by drying and deterioration in an image caused by the changes, and leakage. In contrast, the ink must have the reciprocal characteristics that it penetrates and is dried and fixed promptly when printed onto a printing medium such as paper.

In order to obtain such an ink that penetrates and is dried and fixed promptly while preventing clogging in the ink jet head, there have been attempts based on the ink composition to add a humectant, penetrant, thickener, and the like, thereby balancing both characteristics. Because the aqueous ink uses water as its major medium, it dries naturally and it is difficult to avoid the problem of clogging caused by drying when the ink is stored for a long period of time and in high temperature and low humidity conditions.

In order to solve such a problem, there have been various proposals including a method for storing an ink jet print head stably and a method for washing a head clogged during storage or the like.

For example, Japanese Patent Application Laid-Open (JP-A) No. 60-139454 discloses a method for long-term storage for a head. This method, however, has, for example, the problem that a storage liquid is mixed with ink during storage. This requires a jetting operation using a large amount of ink when the head is first reused.

JP-A No. 6-8461 discloses a method for washing a clogged head. This method, however, has the problem that because only a small amount of washing solution is used, it has an insufficient washing effect on hardened clogging. Also, bubbles tend to be created, especially on the surface of a water-repellent nozzle, which adhere to the nozzle and are not removed by washing. Moreover, the adoption of this type of structure having no relation to the jetting performance of ink gives rise to the problem of a complicated device.

JP-A No. 61-144357 also discloses a washing method. In this method, however, the flow of the washing solution does not uniformly spread over the entire surface of the nozzle with the result that some parts of the surface of the head are not washed.

A method is proposed in JP-A No. 4-115954 in which a washing solution comprising an organic solvent, surfactant, and water is sprayed onto the surface of ahead. This method, however, has an insufficient washing effect on hardened clogging with aqueous ink.

In this manner, there is a demand for measures to recover from clogging with ease.

The manufacturers fill an ink jet head with ink to perform printing inspection prior to its delivery and deliver the ink jet head after the ink is removed and the head is washed. After the head is delivered, it is exposed to stressful conditions such as long-term storage in the market. This can cause clogging and printing defects occur in an early stage after the start of its operation. This is caused by the washing solution which remains unremoved in the head after the ink is removed and the head is washed.

Therefore, there is a demand for means to maintain an ink jet head in a normal condition even when it is not used but stored for a long period of time.

In view of this, there have been various proposals on washing solutions and washing methods for an ink jet head when aqueous ink is used.

For instance, a washing method using a washing solution having a coefficient of viscosity lower than ink is disclosed in JP-A No. 63-260451. A washing solution comprising water, an organic solvent, and a surfactant is proposed in JP-A No. 4-115954. A washing method using a washing solution of a highly alkaline solution or surfactant solution is disclosed in JP-A No. 6-8471.

Even if these washing solutions and washing methods are used, however, the residue obtained after washing is finished, where these washing solutions contain a highly viscous material, coagulates into a highly viscous material which causes clogging in the fine flow passage of an ink jet head and adheres to a nozzle face whereby printing defects tend to be caused. When the washing solution is a highly alkaline solution, a highly concentrated alkaline material adheres to the head and corrodes the head material, when the residual washing solution dries in the nozzle. In addition, because no disinfectant/germicide treatment is performed, the viable cell number in the washing solution is large. Therefore, the residual washing solution remaining in the ink jet head is deteriorated imparting an adverse effect. Also, the washing solution is deteriorated during long-term storage.

JP-A No. 58-71170 proposes a method for discharging the washing solution using air after ink is replaced with a washing solution. This method has an object of preventing clogging derived from the deteriorated washing solution residue and the like.

However, even if the washing solution is discharged from the ink jet head and the head is stored in an empty condition, the residue remaining unremoved causes the same problems as above.

SUMMARY OF THE INVENTION

Accordingly, an object of the present invention is to provide an ink jet head washing solution which restores a print head, which has caused problems such as clogging and the like, to its normal condition and maintains the print head in a normal condition when it is stored at high temperature or for a long period of time, thereby maintaining a high image quality, to provide a method for producing the washing solution, and to provide a method for washing an ink jet head.

Another object of the present invention is to provide a method for effectively washing an ink jet print head, the print head having a nozzle whose surface is ink-repellent, the method having a high degree of efficiency and being capable of easily restoring a print head suffering from the problem of clogging, for example, to its normal condition without using a complicated device.

The present inventors directed their attentions to the solubility of an evaporation residual component in ink which component caused clogging in the ink jet head and to a residual component giving rise to clogging and printing defects after being washed. The residual component after being washed includes a large amount of substances with a viscosity of 10 mPas or more at 25° C., substances which were solid at 25° C., and substances derived from a fungous proliferation and the residual component causing clogging could be dissolved in a basic polar solvent with low viscosity such as water and lower alcohol. The present invention was thus completed.

According to a first aspect of the present invention, there is provided a washing solution for an ink jet head of an ink jet printer which prints using an aqueous ink, the washing solution comprising 80% by weight or more of water and 1.0% by weight or less of a substance with a viscosity of 10 mpas or more at 25° C. and/or of a substance which is a solid at 25° C., the viable cell number in the washing solution being 0.5/ml or less, wherein the washing solution has a viscosity between 0.6 and 3.0 mpas at 25° C. and an electroconductivity between $3\times10^{-2}$ and $3\times10^{-5}$ S/m.

The washing solution according to the first aspect of the present invention and a method for washing an ink jet head using this washing solution can protect an ink jet head from accidents caused by a leakage of ink and drying under stressful conditions, e.g. high temperature storage, long-term storage, strong impact, and atmospheric pressure reduction and stably maintains a print image quality the same as before these stresses are applied. The washing solution according to the first aspect of the present invention is also low in viscosity and high in solubility. Hence even if there is clogging caused by the strong precipitation and fixing of an ink component onto the nozzle surface of the ink jet head, the washing solution easily penetrates into fine gaps between precipitates, whereby the precipitated component can be dissolved. Therefore, the ink jet head whose nozzle suffers from clogging can be restored to its normal condition in an extremely simple manner by the washing solution and the method for washing an ink jet head using the washing solution.

If the maker performs such a washing and delivers an ink jet head after a printing inspection is finished, the reliability in the market is improved. Where an ink jet head is expected to be exposed to severe stressful conditions, such a washing operation avoids the situation which gives rise to problems such as a deterioration in image quality. Further, ink jet heads suffering from problems such as clogging caused by stresses in the market can be restored with ease.

The forgoing is primarily for the explanation of the washing of an ink jet head using the washing solution. The present invention has an additional effect. In the washing of an ink jet head, maintenance parts are washed at the same time. In printers which are used by customers copying a considerable number of sheets or which have been used for approximately five years, maintenance parts, e.g. the wiper for cleaning a nozzle surface, nozzle cap parts, the suction maintenance pump, and the passage to the waste ink absorber may be operating in an abnormal manner due to the adherence of ink. Even in this case, the maintenance unit can be restored to its normal condition by washing the head and the maintenance parts at the same time using the method for washing an ink jet head by using the washing solution of the present invention.

The present inventors also found that the above second object could be achieved by dipping a nozzle face in a washing solution containing water as a major component in the washing of an ink jet head which prints by jetting an aqueous ink from a nozzle having a water-repellent surface.

According to the second aspect of the present invention, there is provided a method for washing an ink jet print head which prints by jetting an aqueous ink from a nozzle having a water-repellent surface, the method comprising a step of dipping a nozzle face of the print head in a washing solution

DESCRIPTION OF THE PREFERRED EMBODIMENTS

The present invention will now be described in detail.

The water used in the present invention is a major component of the washing solution of the present invention. Preferably the water is refined to some extent to obtain a washing solution comprising 1.0% by weight or less of a substance with a viscosity of 10 mPas or more at 25° C. and/or of a substance which is a solid at 25° C. and preferably a viable cell number of 0.5/ml or less. The water has a viscosity between 0.6 and 3.0 mPas at 25° C. and an electroconductivity of $3\times10^{-2}$ or less, preferably between $3\times10^{-2}$ and $3\times10^{-5}$ S/m. The water may be, for example, ultrasonically treated water, magnetization water, electrolytic water, or ionization water as well as ultra-pure water, pure water, ion exchange water, distilled water, or degased water from which a gas, such as dissolved oxygen, present in the water is degased.

In particular, because the electroconductivity of a washing solution is dependent on the electroconductivity of the water used as a raw material, the electroconductivity of the water is preferably $2\times10^{-4}$ S/m or less at 25° C., more preferably $8\times10^{-5}$ S/m or less at 25° C.

These refined waters can be obtained using conventionally known methods.

Figure 1:
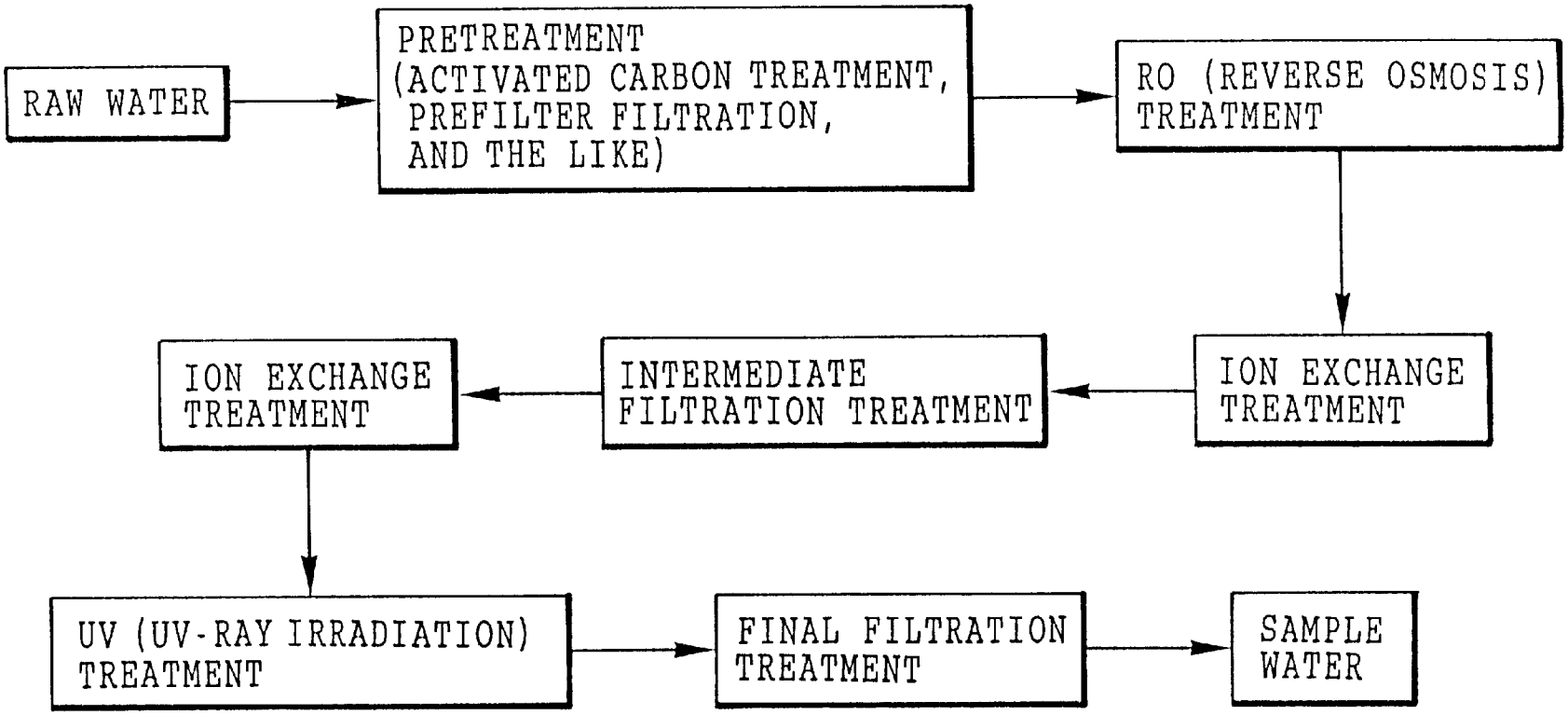
FIG. 1 is a flow sheet illustrating a method for the production of ultra-pure water.
Figure 2A:
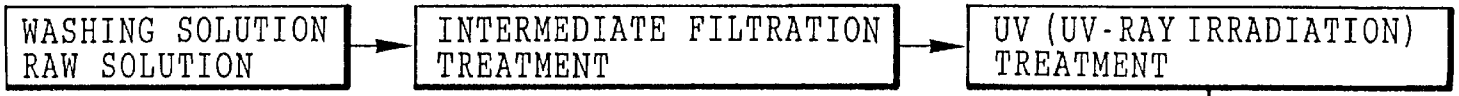
FIGS. 2A to 2D are flow sheets illustrating an embodiment of a method for the production of a washing solution according to the present invention.
Figure 2B:
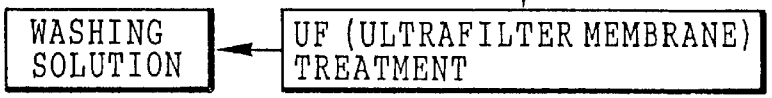
Figure 2B:
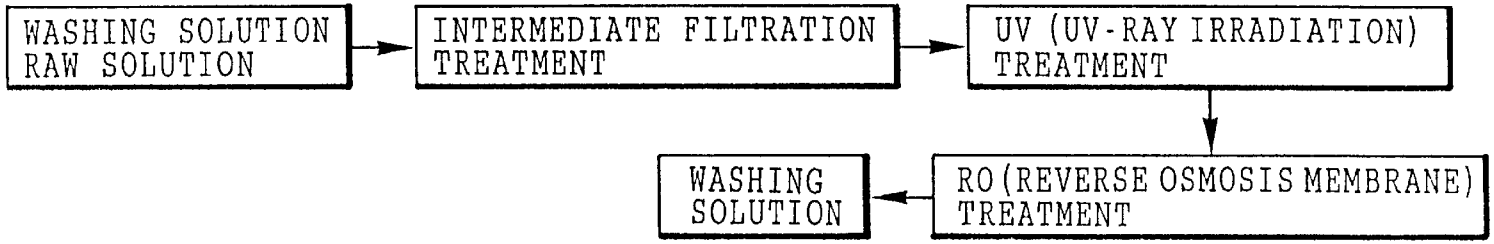
Figure 2C:
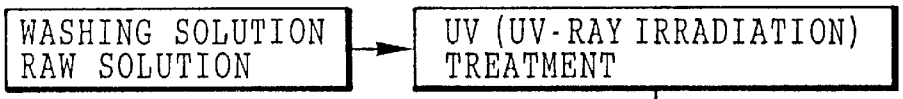
Figure 2D:
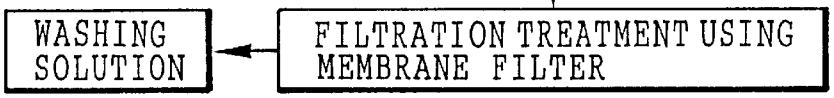
Figure 2D:
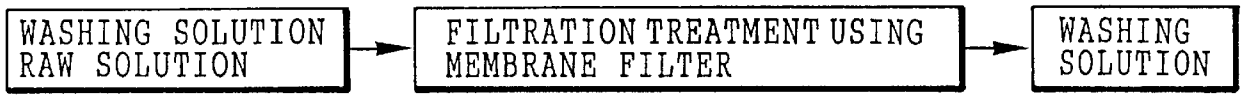

For example, in the case of ultra-pure water, as shown in FIG. 1, using tap water or well water as raw water, it is subjected to pretreatment such as active carbon treatment for removing coarse particles. The pretreated water is then subjected sequentially to reverse osmosis treatment for removing microparticles, ion exchange treatment for removing dissolved ions, intermediate filter treatment for removing microparticles produced during these treatments, ion exchange treatment for further removing ionic substances to improve the degree of refinement, and UV-ray irradiation treatment for sterilization followed by final filtration treatment. Thus ultra-pure water having a viable cell number of 0.01/ml or less, a viscosity of 0.9 mPas at 25° C., and an electroconductivity of $7\times10^{-7}$ S/m can be obtained.

The washing solution of the present invention contains 80% by weight or more of water as its major component. When the amount of components other than water is larger than 20% by weight, the dissolution capability of the washing solution rapidly reduces and hence the intended effect cannot be obtained. In addition, other substances such as highly viscous substances also increase in amount. Therefore when the washing solution remains in the ink jet head after washing is finished, this gives rise to the problems of clogging of the nozzle caused by generation of residual substances with high viscosity and by precipitation of solid substances, and of printing defects caused by residual substances adhering to the nozzle face.

The washing solution of the present invention may contain components such as an aqueous organic solvent and a surfactant other than water. Although such components are not preferably contained in order for the water to exhibit its dissolution capability to the full, these compounds are effective in controlling the penetration of the washing solution into the inside of the ink jet head and the wettability to an inside wall surface, and in enabling the inside of the ink jet head to be washed more efficiently over a larger area.

In particular, an aqueous organic solvent with low viscosity is preferable because it greatly aids the penetration of the washing solution into the ink jet head.

Specific examples of the aqueous organic solvent include, but are not limited to, polyvalent alcohols and polyalkylene glycols such as ethylene glycol, diethylene glycol, triethylene glycol, polyethylene glycol, propylene glycol, 1,5-pentane diol, glycerin, and thiodiglycol; glycol ethers such as ethylene glycol monomethyl ether, ethylene glycol monobutyl ether, diethylene glycol monoethyl ether, diethylene glycol monobutyl ether, triethylene glycol monobutyl ether, and propylene glycol monomethyl ether; pyrrolidone, N-methyl-2-pyrrolidone, triethanolamine, dimethylsulfoxide, sulfolane; as well as alcohols such as ethanol, isopropanol, butanol, and benzyl alcohol; and alkanolamines such as monoethanolamine, diethanolamine, and triethanolamine, and the like.

Among these compounds, glycol ethers are preferable since they have comparatively low viscosity and are effective in improving the penetrability so that the washing solution can be widely spread over the inside of the print head in an efficient manner. Lower alcohols have the same effect as glycol ethers and further low boiling points and they are hence preferable to aid drying after washing. Among these alcohols, methanol, ethanol, n-propanol, isopropanol, sec-butanol, and benzyl alcohol are particularly preferable.

As the surfactant, any of nonionic surfactants, anionic surfactants, cationic surfactants, and amphoteric surfactants may be used. Among these, nonionic surfactants are preferable as they suppress the increase in the electroconductivity of the washing solution. When an ionic surfactant is added, it is preferably added in an amount of 0.01% by weight or less because even a small amount causes a rapid increase in the electroconductivity.

Specific examples of nonionic surfactants include polyoxyethylenealkyl phenyl ethers such as polyoxyethylenenonyl phenyl ether, polyoxyethyleneoctyl phenyl ether, and polyoxyethylenedodecyl phenyl ether; polyoxyethylenealkyl ethers, polyoxyethylene fatty acid esters, sorbitan fatty acid esters, polyoxyethylene/polyoxypropylene block copolymers, ethylene oxide adducts of acetylene glycol, ethylene oxide adducts of glycerin, polyoxyethylenesorbitan fatty acid esters, and fatty acid alkylolamides. Among these compounds, polyoxyethylenealkyl ethers, polyoxyethylene/polyoxypropylene block copolymers, and ethylene oxide adducts of acetylene glycol are particularly preferable.

Preservatives, fungicides, bactericides, and the like may be added to the washing solution, if desired. Inclusion of such components is undesirable in order for the water to exhibit its dissolution capability to the full, but is effective in suppressing fungous proliferation.

As theses preservatives, fungicides, and bactericides, benzoic acid, sodium benzoate, sodium dehydroacetate, potassium sorbate, sodium sulfite, sodium hyposulfite, or the like may be used.

In the washing solution of the present invention, the content of a substance having a viscosity of 10 mpas or more at 25° C. and/or of a substance which is a solid at 25° C. may be 1.0% by weight or less. The substance having a viscosity of 10 mPas or more at 25° C. and/or the substance which is a solid at 25° C. tend to remain in the ink jet head after the head is washed and to be coagulated into a highly viscous material. Addition of 1% by weight or more of these substances tends to bring about clogging of the nozzle caused by the coagulation of highly viscous materials and printing defects caused by residues adhering to a nozzle face.

Because many polyvalent. alcohols and polyalkylene glycols, even though they are the aforementioned aqueous organic solvents, have high viscosities, the amount of each of these compounds may be 1% by weight or less and preferably 0.1% by weight or less.

In addition, if the number of microparticles with a size of 0.2 $\mu$m or more in the washing solution is 100/ml or less, the amount of residue produced when a residual washing solution in the head after washing the head becomes very small whereby the reliability of the print head is improved.

The viable cell number in the washing solution of the present invention is 0.5/ml or less and preferably 0.25/ml or less.

When the viable cell number in the washing solution is more than 0.5/ml, fungi grow during storage of the solution and solids in the solution increase and the washing solution is thereby deteriorated. Also, fungi tend to proliferate in the washing solution remaining unremoved in the nozzle. This causes nozzle clogging and printing defects and hence the characteristics of the ink jet head are impaired.

The viscosity of the washing solution of the present invention is in a range from 0.6 to 3.0 mPas and preferably from 0.7 to 1.5 mPas at 25° C. When the viscosity is less than 0.6 mPas, the washing solution is reduced in its function of sweeping out foreign substances such as non-aqueous microparticles thereby impairing the performance of the ink jet head. On the other hand, if the viscosity is 3.0 mPas or more, the penetration of the washing solution into fine passages inside the head is slow thereby reducing the washing efficiency.

The electroconductivity of the washing solution of the present invention is in a range from $3\times10^{-5}$ to $3\times10^{-2}$ S/m at 25° C. and preferably from $3\times10^{-5}$ to $1\times10^{-2}$ S/m at 25° C.

The washing solution of the present invention possesses a high capability of dissolving highly viscous components in ink such as solids and moisture retentive agents. This high dissolution capability is maintained by keeping the electroconductivity of the washing solution below $3\times10^{-2}$ S/m. This is because the dissolution capability of an aqueous solution is depending on the existence of water molecules or water clusters which are capable of coordinating in terms of hydration. Further, if ionic substances, aqueous substances with high viscosity and the like, which consume water molecules and water clusters capable of coordinating in terms of hydration, exist in water, the dissolution capability decreases as the electroconductivity increases. On the other hand, when the electroconductivity is less than $3\times10^{-5}$ S/m, the washing solution tends to be charged and thereby to draw in dust and the like contained in the air. If such a washing solution is used, dust tends to remain in the ink jet head, impairing the performance of the ink jet head.

The washing solution is produced by blending the above raw materials. Highly viscous substances, solid materials, fungi, and the like which are derived from the raw materials and are contaminated in the course of manufacturing process should be removed. Therefore, after the raw materials are blended, it is preferable to treat the raw materials of a washing solution, in at least one step selected from the group consisting of a sterilization step using UV-ray irradiation, a step of filtering using a membrane filter with a pore size of 0.5 μm or less, a step of filtering using an ultrafiltration membrane, and a step of filtering using a reverse osmosis membrane. It is more preferable to perform at least a sterilization step using UV-ray irradiation because an excellent sterilization performance can be obtained. Preferably, before this step, an intermediate filtration treating step of removing coarse particles may be provided. Furthermore, a step of deaerating gas, such as oxygen, in the washing solution may be, provided as the final step, if necessary.

The sterilization step using UV-ray irradiation is used primarily to kill viable cells contained in a raw washing solution and to prevent the proliferation of fungi. This step is carried out by applying UV-rays from a high intensity UV lamp. The step of filtering using a membrane filter is performed using a membrane filter with a pore size of 0.5 μm or less primarily to remove impurity particles, miscellaneous germs, and the like with a size over 0.5 μm in the solution. The method of filtering using an ultrafiltration membrane is performed using a commercially available ultrafilter primarily to remove microparticles with a size of 0.01 μm or less and miscellaneous germs. The step of filtering using a reverse osmosis membrane is also a step of removing microparticles with a size of 0.01 μm or less and miscellaneous germs and is performed using a commercially available reverse osmosis filter.

These steps may be used in optional combinations of two or more.

FIGS. 2A to 2D are flow sheets illustrating an embodiment of a method for the production of the washing solution according to the present invention.

Production method A comprises a sterilization step using UV irradiation and a step of filtering using an ultrafiltration membrane. Production method B comprises a sterilization step using UV irradiation and a step of filtering using a reverse osmosis membrane. Production method C comprises a sterilization step using UV irradiation and a step of filtering using a membrane filter with a pore size of 0.5 μm or less. Production method D comprises a step of filtering using a membrane filter with a pore size of 0.5 μm or less.

The washing solution of the present invention can be used in any method for washing the ink jet head. Moreover, after the print head is washed, it can be kept in a state where it is filled with residual washing solution.

However, the reliability in preventing leakage of solution and the like is higher when the washing solution is removed. Taking this into consideration, it is desirable to use a washing method comprising a step of washing the ink jet head using a washing solution and a step of removing the solution remaining in the ink jet head after the washing when the ink jet head is intended to be stored for a long period of time.

Conventional washing solutions may not be incompletely removed even if the step of removing the solution remaining in the print head after a washing step is performed. The washing solution unremoved becomes thickened, which often causes the problem such as deteriorated image quality when the print head is refilled with ink and is used for printing. On the contrary, when using the washing solution of the present invention, evaporation residue is very small and thickening during drying is also small. Therefore the washing solution of the present invention does not cause such a problem.

The step of washing the ink jet head using a washing solution comprises the steps of introducing the washing solution into the flow passages of the ink jet head and washing these flow passages. A process for introducing washing solution into the flow passages of the ink jet head may be, for example, a process of supplying the washing solution from the side of the ink flow passages of the print head using a tube and a washing solution tank, and a process of supplying the washing solution by spraying the washing solution onto the nozzle face using a spray. Among these processes, the simple process of supplying a washing solution by using a washing solution tank and the like is desirable from the point that the ink jet head can be washed while in an ink jet recording device. Furthermore, means of supplying washing solution by increasing and decreasing pressure or by driving the print head to thereby form a jet flow may be used in combinations of two or more, in order to introduce the washing solution efficiently into the print head.

A process for washing the inside of the flow passages of the ink jet head may be performed by an operation of making solution droplets by effecting heat energy on the washing solution and alternate operations of pressuring and suction. The number of repetitions of these operations is preferably 1 to 10 and more preferably 3 to 10 to enhance the washing effect.

The step of removing the solution remaining in the ink jet head after washing means that waste washing solution is externally discharged from the inside of the ink jet head.

The discharging methods include a process of discharging washing solution from the nozzle by pressuring or suction and a process of discharging solution droplets by driving the print head.

Especially when the ink jet head is constructed of a head tank separable type print head unit in which the print head and the ink tank can be separated, a structure in which the washing tank can be replaced with the ink tank can be adopted. In this case, the ink jet head can be washed by replacing the ink tank with the washing solution tank. This makes it possible to forego providing a separate washing solution tank in the device. This structure is also desirable because not only the ink jet head but also the entire flow passages can be washed.

When a washing solution tank or the like is used to supply the washing solution, it is preferable that a washing solution support material is provided in the device to prevent leakage of solution inside the device. The washing solution support material may include well-know materials as an ink support material, such as foaming materials, liquid-includable materials porous materials and chemical fiber materials.

The washing method according to the second aspect of the present invention comprises the steps of removing the ink jet printer head from a printer, mounting the print head on a washing device, and keeping the print head for a prescribed period of time in a vessel, disposed in the washing device and filled with washing solution, such that at least the nozzle face of the print head is dipped in the washing solution; and the consecutive steps of preferably removing the print head from the washing device and suction using a pump.

As a method for jetting ink, various types are proposed. These types include charge control types, pressure pulse types by drop on demand, and thermal ink jet types. Because the present invention adopts a method in which only the print head is removed and washed, the method of the present invention can be applied to printer heads of any jetting type and has a high washing effect.

The method of the present invention has a particularly excellent effect on the washing of aqueous inks such as an aqueous dye ink, pigment-dispersion-type aqueous ink, and aqueous emulsion ink. However, the washing object is not limited to these inks.

Generally, the nozzle face of a print head has a water-repellency to suppress the adhesion of ink and the like to the periphery of the nozzle which adhesion causes ink jetting defects. More specifically, the nozzle face has an ink-repellency against aqueous ink (these properties are hereinafter simply called "water-repellency"). To explain in detail, the contact angle of the ink with a nozzle face used in the printer is designed to be over 60 degrees. The provision of a step of dipping, in a washing solution, a nozzle face having such a water-repellency ensures that the washing solution penetrates into a wide area of the print head. This allows the exhibition of the dissolution capability of the washing solution using water as its major component.

Figure 8A:
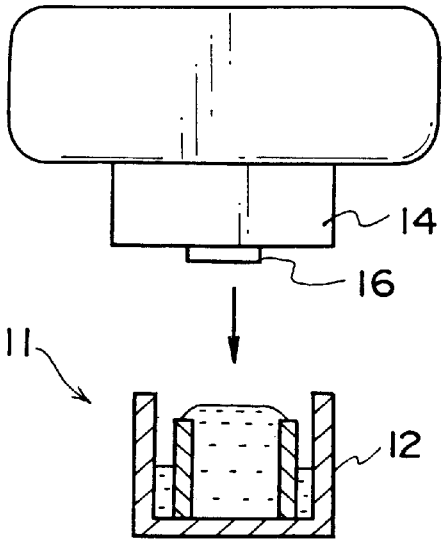
FIG. 8A is a schematic view showing a washing device used in Example II-1.
Figure 8B:
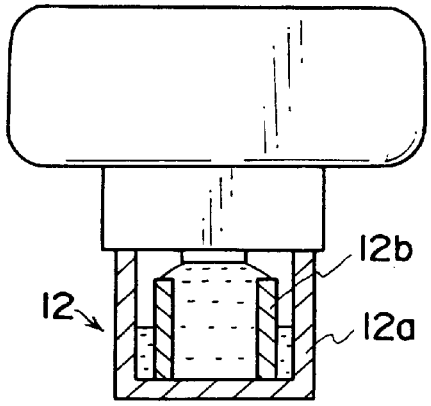
FIG. 8B is a schematic view showing a condition in which the nozzle face of a print head is dipped in the washing solution used in the washing device shown in FIG. 8A.

FIG. 8A is a typical view showing an embodiment of a washing device which can be suitably used in the washing method of the present invention. A washing device 11 is provided with a vessel 12 filled with a washing solution. A print head 14 removed from a printer is conveyed to the vessel 12 and disposed, as shown in FIG. 8B, such that the surface of a nozzle 16 positioned at the end of the print head 14 is dipped in the washing solution. The print head 14 is kept in this condition for a prescribed period of time.

As shown in FIG. 8, the vessel 12 filled with washing solution is formed in a double structure provided with an outside wall and an inside wall, whereby efficient washing can be performed using a small amount of a washing solution.

Figure 9A:
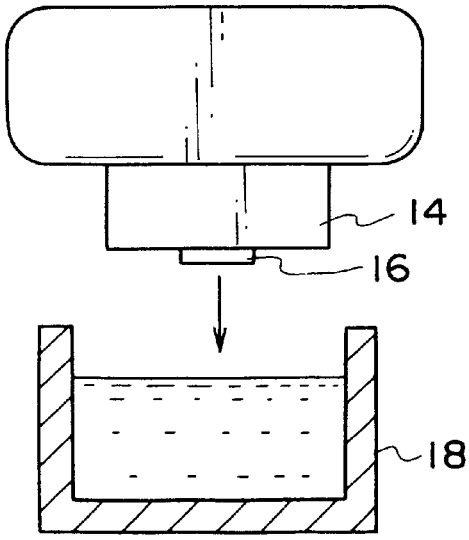
FIGS. 9A and 9B are schematic views showing a one-bath-type washing device used in the washing method of Example II-4.
Figure 9B:
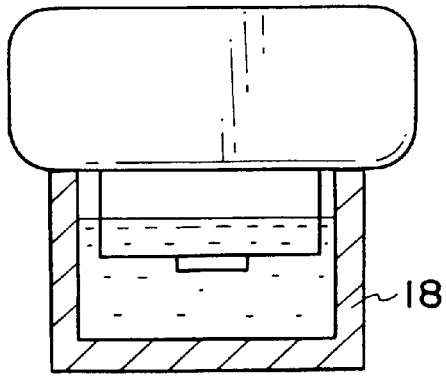

FIGS. 9A and 9B are typical views showing another embodiment of a washing device which can be suitably used in the washing method of the present invention. As shown in this device, the vessel 18 containing washing solution may be a one-bath type. When the area of the opening of the vessel 18 is made larger than the end of the print head 14 as shown in FIGS. 9A and 9B, not only the nozzle 16 but also the end of the print head 14 can be dipped in the washing solution. Therefore, the penetrability of the washing solution into the opening of the nozzle due to hydraulic pressure is improved and splashed ink adhering to the end of the print head 14 can be removed at the same time.

As the washing solution used in the method according to the second aspect of the present invention, a washing solution using water as its major component is used in view of its affinity to an aqueous ink. The content of water contained in the washing solution may be 80% by weight or more and preferably 90% by weight or more.

In particular, it is preferable that the washing solution has a viscosity ranging from 0.7 to 5.0 mPas and the relation between the surface tension (dyn/cm) and viscosity (mPas) of the washing solution satisfy the following formula (1) to obtain high penetrability into clogged substances.

$$\text{Surface tension/Viscosity} \geqq 10 \quad (1)$$

It is more preferable that Surface tension/Viscosity$\geqq$403.

A viscosity exceeding 5.0 mPas and a value of surface tension/viscosity of less than 10 are undesirable because the washing solution does not penetrate sufficiently into the pores of the nozzle.

Incidentally, the viscosity and surface tension of the washing solution can be easily measured using a viscometer (manufactured by Rheomat Co., Ltd.) and a surface tension balance (KYOWA Interface Science Co., Ltd.) under an atmosphere of 25° C. respectively.

In view of corrosion and dissolution of the material of the head and the influence on the peeling of the adhesive inside of the head, the washing solution has a pH ranging preferably from 3 to 11. A pH ranging from 7 to 11 is preferable with a view of high washing capability.

The water, which is a major component of the washing solution used according to the second aspect of the present invention, maybe for example, ultrasonically treated water, magnetization water, electrolytic water, or ionization water as well as ultra-pure water, pure water, ion exchange water, distilled water, or degased water. From which a gas, such as dissolved oxygen, present in the water is degased. Water, e.g. tap water, containing impurities is undesirable in view of its preservation properties and washing effects. Stated another way, as for water including ions such as a calcium ion capable of forming insoluble salts, such ions are precipitated as insoluble salts due to the interaction with ink and are insolubilized thereby reducing the penetrability of the washing solution into the nozzle. Water containing organic materials increases in viscosity due to proliferation of microorganisms and deterioration of the organic materials. Either of the above cases is therefore undesirable. In light of this, ultra-pure water, pure water, and ion exchange water are preferable and ultra-pure water containing neither ionic substances, nor organic materials, nor any solid substance is more preferable.

Preferably the washing solution used according to the second aspect of the present invention, like the washing solution according to the first aspect of the present invention, comprises a surfactant and/or an aqueous organic solvent to improve the penetrability into the nozzle.

The surfactant contained in the washing solution used in the present invention may be any of nonionic, anionic, cationic, and amphoteric surfactants. Among these, nonionic surfactants are preferable because of their excellent washing effects.

As specific examples of the nonionic surfactants, the aforementioned nonionic surfactants used in the washing solution according to the first aspect of the present invention may be given, though not limited to these.

There are no specific limitations to the content of these surfactants and the content may be optionally selected according to the shape of the object to be washed and the composition of ink. The content is preferably in a range from 0.01 to 1.0% by weight.

As specific examples of the aqueous organic solvent may be, but are not limited to, the aforementioned aqueous organic solvents used in the washing solution according to the first aspect of the present invention. Among these, glycol ethers and lower alcohols which have one or more hydroxyl groups in a molecule are preferable because these compounds have comparatively low viscosity and effects of improving the penetrability enabling the washing solution to spread out efficiently over a large area in the print head.

No particular limitations are imposed on the content of these aqueous organic solvents. The content is optionally selected corresponding to the shape of the washing object and the composition of the ink and is preferably in a range from 0.1 to 20.0% by weight.

The temperature of the washing solution is preferably between about 5 to 50° C. When the temperature is less than 5° C., the capability of dissolving the ink with which the nozzle is clogged and the penetrability into the opening of the nozzle decrease. When the temperature exceeds 50° C., the stability of the washing solution tends to decrease. So the above defined range is desirable.

Other than the above components, if desired, additives such as preservatives, fungicides, bactericides, and pH buffers may be added to the washing solution according to the present invention as long as the effect of the present invention is not impaired.

The washing method of the present invention may comprise a step of keeping the print head for a prescribed time such that at least the nozzle face of the print head is dipped in the washing solution. The dipping time is preferably 3 minutes or more and more preferably 5 minutes or more. If the dipping time is less than 3 minutes, the washing solution is insufficiently spread in the opening of the nozzle resulting in insufficient production of the effects of the present invention.

It is preferable to add steps of removing the print head from the washing device and suctioning the washing solution using a pump to remove the washing solution and further a step of discharging the ink while the printing machine is in an idle state to replace the washing solution with ink thereby completely removing the washing solution after the step of dipping the print head in the washing solution. Solid substances which are dissolved to be in a separable form can be removed by these steps.

The step of discharging the ink while the printing machine is in an idle state to replace the washing solution with ink is also efficient since the removal of the washing solution and the supply of ink can be made at the same time. In this case, ink is mixed with the washing solution. However, because the amount of washing solution unremoved is slight, this washing solution can be removed by a small amount of ink.

As mentioned above, in the step of dipping the nozzle face in the washing solution, even a small amount of the washing solution imparts an effect. It is preferable that the amount of the washing solution satisfies the following formula (2), since the washing solution maintains a high capability of dissolving substances causing clogging.

$$\text{Amount of washing solution (ml)}/(\text{Area of opening of nozzle } (\text{mm}^2)\times\text{Number of nozzles})>16, \quad (2)$$

wherein the "Area of opening of nozzle" means the area of the outlet of ink per nozzle. When this value is 16 or more, the washing solution is sucked toward the opening of the nozzle whereby the dipping effect may not be obtained.

It is more preferable to satisfy the formula (3) because a large amount of the washing solution is not required. Specifically, if the value of the formula (3) is 50 or more, the washing solution spreads out widely extending deep into the opening of the nozzle to thereby produce the desirable effects. On the other hand, even if the value of the formula (3) exceeds 260, this poses no problem. However, the washing solution is used in a large amount which causes the washing device to be large in size while no improvement corresponding to the increased device size is made.

$$260>\text{Amount of washing solution (ml)}/(\text{Area of opening of nozzle } (\text{mm}^2)\times\text{Number of nozzles})>50 \quad (3)$$

Figure 10A:
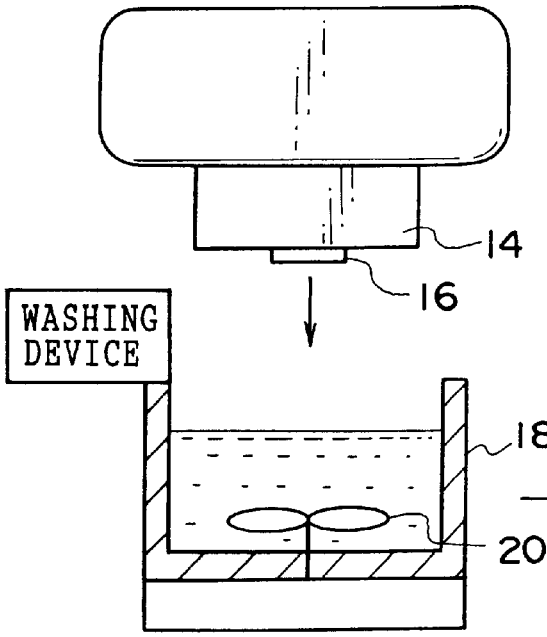
FIGS. 10A and 10B are schematic views showing a washing device provided with a stirring means in a vessel which is used in the washing method of Example II-5.
Figure 10B:
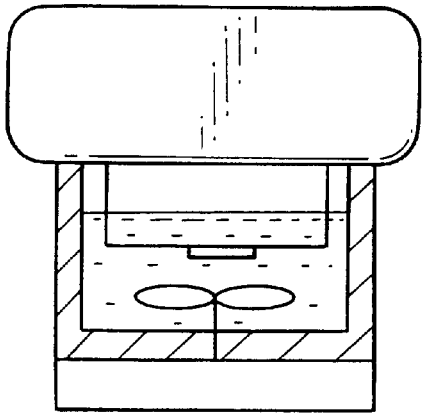

Also, in the dipping step, as shown in FIGS. 10A and 10B, means 20 for stirring the washing solution may be provided, thereby enabling the dipping step to be performed while the washing solution is stirred. The washing solution contaminated with dissolved ink, foreign materials, and the like can be replaced with an uncontaminated washing solution and hence the washing can be accomplished in a short time in an efficient manner. Also, from the same point of view, operations of discharging the ink while the printing machine is in an idle state. By driving the head and applying ultrasonic waves may be carried out in the dipping step. The dissolution capability can be further improved by a cavitation action due to these operations. The dissolution capability can be also improved by raising the temperature of the washing solution. However, a significant rise in the temperature may cause the stability of the washing solution to be impaired. It is practically desirable that the temperature be up to approximately 50° C.

If the washing method of the present invention is used, a print head whose nozzle is clogged under stressful conditions, for example storage at high temperatures or long-term storage, can be restored to its normal condition in a short time by a simple operation. Thus, print heads which are troubled with problems, such as clogging, in the market can be restored to their normal condition with ease.

When washing print heads equipped with a plurality of nozzles discharging inks of different colors, washing solution is used in a large amount based on the capacity of the nozzle in a short time in the method of the present invention. Therefore the plurality of nozzles can be washed at the same time without the problem of color mixing caused by colored washing solutions remaining unremoved in those nozzles.

Furthermore, a washing solution vessel having a large opening area as shown in FIGS. 9A and 9B are used in the washing method of the present invention, the print head and maintenance parts, attached to the print head, such as a wiper cleaner installed adjacent to the print head can be washed simultaneously. Thus the performances of a maintenance device can be restored by one washing step.

EXAMPLES

The present invention will be illustrated in more detail by way of examples and comparative examples.

Example I-1

Figure 3:
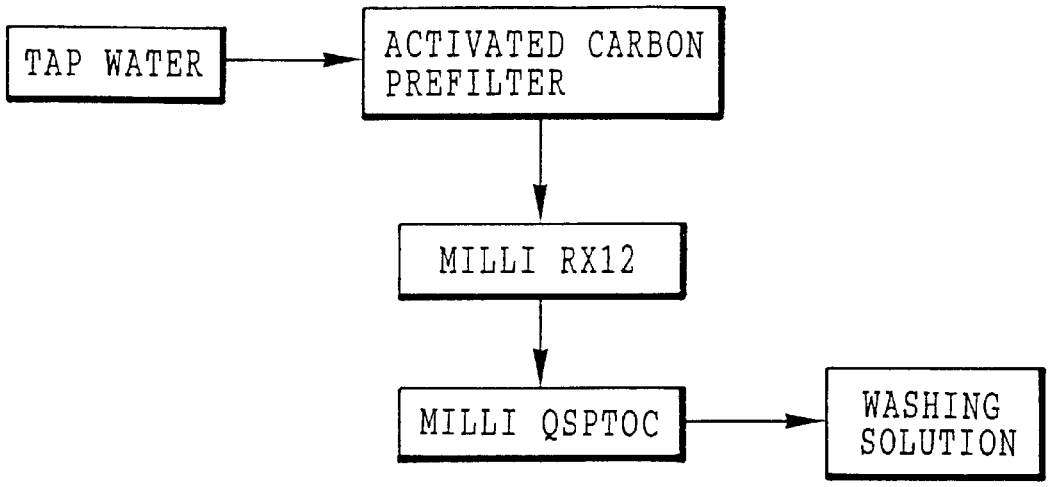
FIG. 3 is a flow sheet illustrating a method for the production of the washing solution of Example 1 described hereinafter.

Using tap water as raw water, the raw water is pretreated by using a prefilter containing activated carbon (manufactured by Millipore Co., Ltd.) according to the process flow shown in FIG. 3. The pretreated raw water is then treated in a reverse osmosis filter (trademark: Milli RX 12, manufactured by Millipore Co., Ltd.) in which ion exchange treatment, filter treatment using a filter with a pore size of 0.2 $\mu$m as well as reverse osmosis treatment can be conducted. Next, the resulting water is treated in a ultrafilter (trademark: Milli QSPTOC, manufactured by Millipore Co., Ltd.), in which activated carbon treatment, ion exchange treatment, and UV-irradiation treatment as well as ultrafiltration treatment can be conducted, to obtain a washing solution I-1.

Example I-2

| | |
|---|---|
| Washing solution I-1 prepared in Example I-1 | 95.0% by weight |
| Isopropanol (viscosity: 2.07 mPas) | 5.0% by weight |

The above raw materials are mixed at the above ratio and dissolved to prepare a washing solution I-2.

Example I-3

| | |
|---|---|
| Washing solution I-1 prepared in Example I-1 | 99.9% by weight |
| Polyoxyethylenenonyl ether (Solid; 30 mol ethylene oxide adduct) | 0.1% by weight |

The above raw materials are mixed at the above ratio and dissolved to prepare a washing solution I-3.

Example I-4

| | |
|---|---|
| Washing solution I-1 prepared in Example I-1 | 85.0% by weight |
| Ethanol (viscosity: 1.08 mPas) | 15.0% by weight |

The above raw materials are mixed at the above ratio and dissolved to prepare a washing solution I-4.

Example I-5

| | |
|---|---|
| Washing solution I-1 prepared in Example I-1 | 95.0% by weight |
| Diethylene glycol monobutyl ether (viscosity: 5.96 mPas) | 5.0% by weight |

The above raw materials are mixed at the above ratio and dissolved to prepare a washing solution I-5.

Example I-6

| | |
|---|---|
| Washing solution I-1 prepared in Example I-1 | 99.9% by weight |
| Nonionic surfactant (Pluronic PE4300 (manufactured by BASF), viscosity: 100 mPas<) | 0.1% by weight |

The above raw materials are mixed at the above ratio and dissolved to prepare a washing solution I-6.

Example I-7

| | |
|---|---|
| Washing solution I-1 prepared in Example I-1 | 99.95% by weight |
| Nonionic surfactant (Surfinol 465 (manufactured by Nisshin Chemical Industry), viscosity: 100 mPas<) | 0.05% by weight |

The above raw materials are mixed at the above ratio and dissolved to prepare a washing solution I-7.

Example I-8

| | |
|---|---|
| Washing solution I-1 prepared in Example I-1 | 95.0% by weight |
| Isopropanol (viscosity: 2.07 mPas) | 5.0% by weight |
| Polyxoyethylenenonyl ether (Solid; 30 mol ethylene oxide adduct) | 0.1% by weight |

The above raw materials are mixed at the above ratio and dissolved to prepare a washing solution I-8.

Example I-9

The washing solution I-2 prepared in Example I-2 is filtered with a membrane filter (trademark: Durapore, manufactured by Millipore Co., Ltd.) with a pore size of 0.2 $\mu$m to prepare a washing solution I-9.

Example I-10

The washing solution I-2 prepared in Example I-2 is ultra-filtered with an ultrafilter (trademark: Prepscale TFF-1, manufactured by Millipore Co., Ltd.) using a membrane cartridge (PLBC, VF Cartridge (manufactured by Millipore Co., Ltd.)) to prepare a washing solution I-10.

Example I-11

| | |
|---|---|
| Washing solution I-1 prepared in Example I-1 | 99.98% by weight |
| Nonionic surfactant (Surfinol 104 (manufactured by Nisshin Kagaku), viscosity: solid) | 0.02% by weight |

The above raw materials are mixed at the above ratio and dissolved to prepare a washing solution I-11.

Comparative Example I-1

Tap water is sampled and used as it is as a washing solution I-12.

Comparative Example I-2

| | |
|---|---|
| Washing solution I-1 prepared in Example I-1 | 60.0% by weight |
| Glycerin (viscosity: 100 mPas<) | 40.0% by weight |

The above raw materials are mixed at the above ratio and dissolved to prepare a washing solution I-13.

Comparative Example I-3

| | |
|---|---|
| Washing solution I-1 prepared in Example I-1 | 50.0% by weight |
| Isopropanol (viscosity: 2.07 mPas) | 50.0% by weight |

The above raw materials are mixed at the above ratio and dissolved to prepare a washing solution I-14.

Comparative Example I-4

| | |
|---|---|
| Washing solution I-1 prepared in Example I-1 | 99.99% by weight |
| Sodium hydroxide (solid) | 0.01% by weight |

The above raw materials are mixed at the above ratio and dissolved to prepare a washing solution I-15.

Comparative Example I-5

| | |
|---|---|
| Washing solution I-1 prepared in Example I-1 | 50.0% by weight |
| Diethylene glycol (viscosity: 30.0 mPas) | 50.0% by weight |

The above raw materials are mixed at the above ratio and dissolved to prepare a washing solution I-16.

Comparative Example I-6

| | |
|---|---|
| Washing solution I-1 prepared in Example I-1 | 85.0% by weight |
| Ethanol (viscosity: 1.08 mPas) | 13.0% by weight |
| Surfinol 465 (manufactured by Nisshin Kagaku), viscosity: 100 mPas<) | 2.0% by weight |

The above raw materials are mixed at the above ratio and dissolved to prepare a washing solution I-17.

Comparative Example I-7

Commercially available methanol (JIS Highest quality) is used as it is as a washing solution I-18.

Comparative Example I-8

Figure 4:
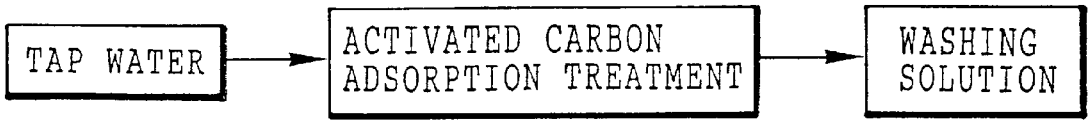
FIG. 4 is a flow sheet illustrating a method for the production of the washing solution of Comparative Example 1 described hereinafter.

Using tap water as raw water, the raw water is continuously treated by using a prefilter containing activated carbon (manufactured by Millipore Co., Ltd.) according to the process flow shown in FIG. 4 to prepare a washing solution I-19.

The following characteristics and washing capabilities of the above washing solutions are evaluated. The results of the evaluations of the characteristics and washing capabilities are shown in Tables 1 and 2 respectively.

TABLE 1

| Washing solution | Electroconductivity ($\times 10^{-4}$ S/m) | Viscosity (mPas) | Microparticles (cells/ml) | Viable cell number (cells/ml) |
|---|---|---|---|---|
| I-1 | 0.7 | 0.92 | 8 | 0.00 |
| I-2 | 0.6 | 1.15 | 15 | 0.00 |
| I-3 | 95 | 1.09 | 33 | 0.02 |
| I-4 | 0.5 | 1.44 | 11 | 0.00 |
| I-5 | 0.7 | 1.26 | 21 | 0.00 |
| I-6 | 65 | 1.23 | 45 | 0.04 |
| I-7 | 54 | 1.09 | 28 | 0.01 |
| I-8 | 62 | 1.29 | 42 | 0.00 |
| I-9 | 0.9 | 1.20 | 3 | 0.00 |
| I-10 | 87 | 1.04 | 4 | 0.00 |
| I-11 | 24 | 1.02 | 85 | 0.01 |
| I-12 | 450 | 0.98 | $4.8 \times 10^5$ | 4.5 |
| I-13 | 0.15 | 4.43 | 11 | 0.1 |
| I-14 | 0.2 | 3.21 | 14 | 0.00 |
| I-15 | 612 | 1.01 | 105 | 0.00 |
| I-16 | 0.26 | 4.15 | 19 | 0.00 |
| I-17 | 230 | 1.51 | 63 | 0.00 |
| I-18 | 0.05 | 0.55 | 81 | 0.00 |
| I-19 | 390 | 0.99 | $3.2 \times 10^5$ | 1.6 |

TABLE 2

| | Washing test 1 | | |
|---|---|---|---|
| Washing solution | Immediately after washing | Stored at 35° C. and 85% RH for 3 months | Washing test 2 |
| I-1 | ○ | ○ | ○ |
| I-2 | ○ | ○ | ○ |
| I-3 | ○ | ○ | ○ |
| I-4 | ○ | ○ | ○ |
| I-5 | ○ | ○ | ○ |
| I-6 | ○ | ○ | ○ |
| I-7 | ○ | ○ | ○ |
| I-8 | ○ | ○ | ○ |
| I-9 | ○ | ○ | ○ |

TABLE 2-continued

| Washing solution | Washing test 1: Immediately after washing | Washing test 1: Stored at 35° C. and 85% RH for 3 months | Washing test 2 |
|---|---|---|---|
| I-10 | ○ | ○ | ○ |
| I-11 | ○ | ○ | ○ |
| I-12 | X | X | Δ |
| I-13 | Δ | X | X |
| I-14 | X | X | X |
| I-15 | Δ | X | Δ |
| I-16 | X | X | X |
| I-17 | ○ | X | Δ |
| I-18 | X | X | X |
| I-19 | Δ | X | Δ |

(Evaluation of Characteristics)

1) Measurement of Electroconductivity

The electroconductivity is measured in an environment of 25° C. using an electroconductivity meter (manufactured by Denki Kagaku Keiki Co., Ltd.).

2) Measurement of Viscosity

The viscosity is measured in an environment of 25° C. using a viscometer (manufactured by Rheomat Co., Ltd.).

3) Measurement of the Number of Microparticles

The number of micropart-icles on a filter membrane for screening microparticles with a size of 0.2 $\mu$m is measured using an optical microscope according to JIS K0554 (1990) (Method for measuring microparticles in ultra-pure water), 4) Measurement of Viable Cell Number The viable cell number is measured according to JIS K0554 (1990) (Test for viable cell number in short-term culturing in test method for measuring the number of bacteria in ultra-pure water).

(Evaluation of Washing Capability)

1) Ink Jet Head Washing Test 1

Figure 5:
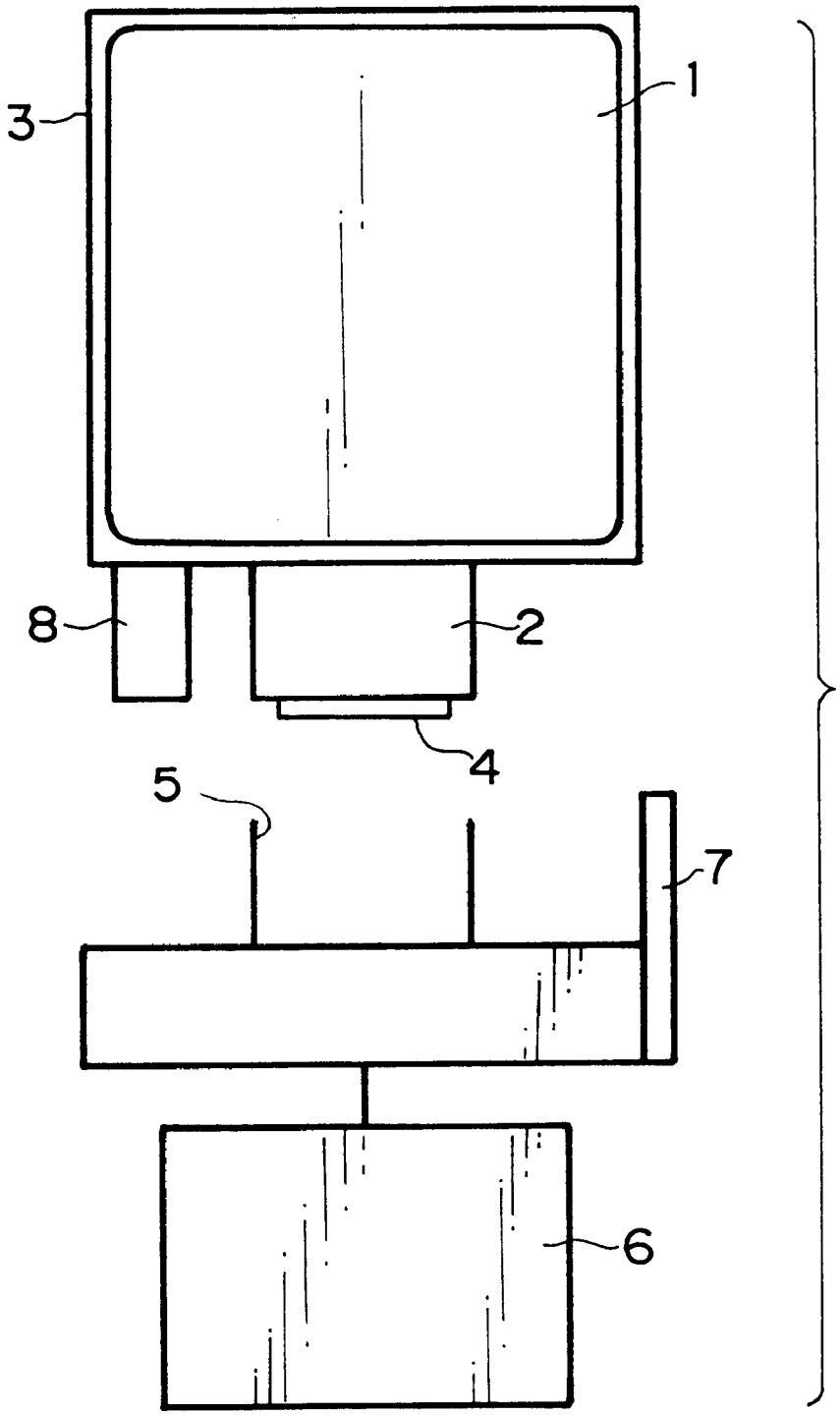
FIG. 5 is a schematic sectional view of an ink jet recording device equipped with a washing solution tank which is used in washing test 1 described hereinafter.

FIG. 5 is a schematic sectional view of an ink jet recording device equipped with a washing solution tank, the device being used in a washing test 1.

The same tank as an ink tank is charged with washing solution. This tank is called washing solution tank 1. Washing solution tank 1 is connected to a print head 2 and stored in a carriage 3. The end of the print head 2 is a nozzle face 4 which is formed with 320 nozzle pores each having an opening with an area of $2\times10^{-4}$ mm$^2$. A cap 5 structured such that it can be applied under pressure to the print head 2 is disposed at the position facing the print head 2. The cap 5 is mounted on a support member and is connected to a suction pump 6. On the support member with the cap mounted thereto, a wiper blade 7 is arranged. A wiper cleaner 8 cleaning the wiper blade 7 is arranged downstream of the print head 2.

Figure 6:
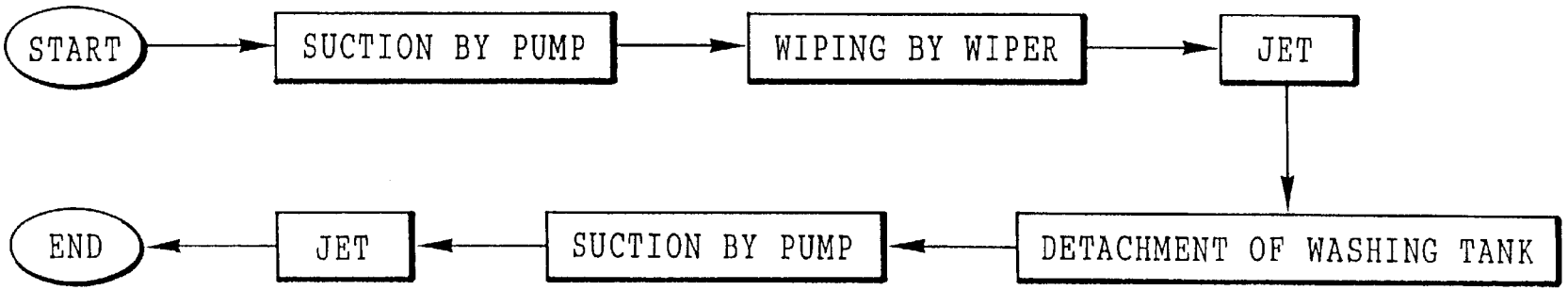
FIG. 6 is a flow sheet showing the washing operation flow in washing test 1 described hereinafter.

According to the washing operation flow shown in FIG. 6, the washing solution is suctioned using a suction pump 6 in a state where the print head 2 is press-contacted to the cap 5 to supply the washing solution from the washing solution tank 1 to the print head 2. Next, the cap 5 is separated from the print head 2 and the nozzle face 4 is wiped with the wiper blade 7. The print head 2 is driven to jet the washing solution from the nozzle face 4. Then the washing solution tank 1 is detached from the carriage 3 and the washing solution is suctioned using a suction pump 6 in a state where the print head 2 is press-contacted to the cap 5 to discharge the washing solution to an unillustrated waste tank. The print head 2 is driven to jet and thereby to discharge the washing solution remaining unremoved to the unillustrated waste tank by capillary force. The ink jet head is thus washed.

Immediately after the washing is completed, an ink tank is mounted on the ink jet head section to fill the ink jet head section with ink and then the printing characteristics thereof are evaluated. Alternatively, after the washing is completed, the ink jet head section is stored at 35° C. and 85% RH for three months in the condition that only the ink jet head section is attached to a trial ink jet printer. Then an ink tank is mounted on the ink jet head section and is charged with ink to evaluate the printing characteristics.

The standard for the evaluation of printing characteristics is as follows:

○: Image defects are not produced.

Δ: A few image defects such as white lines and voids are produced.

X: Many image defects such as white lines and voids are produced.

2) Ink Jet Head Washing Test 2

Figure 7:
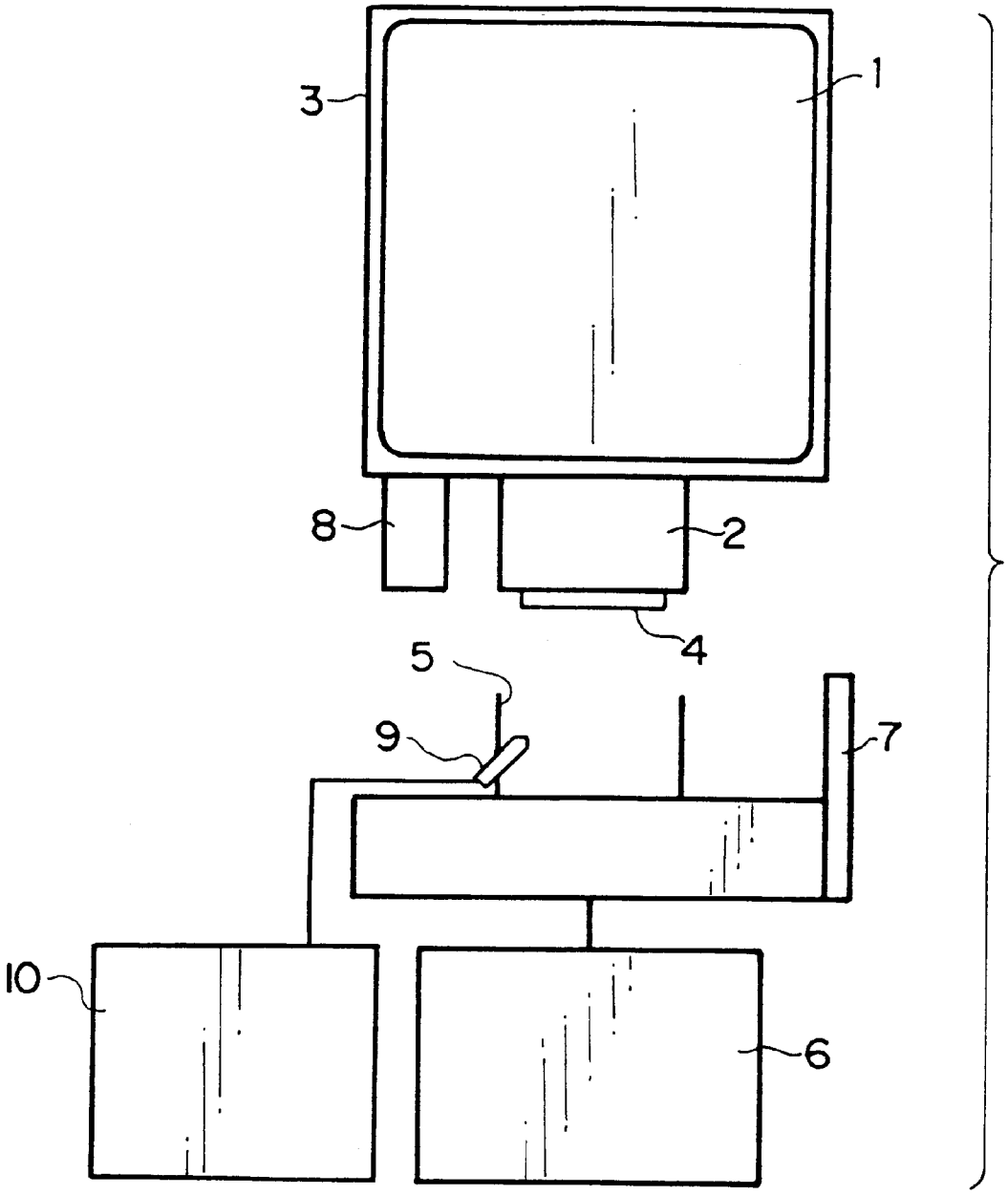
FIG. 7 is a schematic sectional view of an ink jet recording device equipped with a washing solution spray nozzle which is used in washing test 2 described hereinafter.

FIG. 7 is a schematic sectional view of an ink jet recording device equipped with a washing solution spray nozzle, the device being used in a washing test 2.

A washing solution spray nozzle 9 is disposed inside the cap 5. The washing solution spray nozzle 9 is connected to a washing solution jetting pump 10. In FIG. 7, the same structures as in the ink jet recording device in FIG. 5 are represented by the same symbols as in FIG. 5 and an explanation thereof is omitted.

A unit as shown in FIG. 7 is used to restore a print head 2 in a printer suffered from clogging which could not be restored by the usual recovery operation. Washing solution is supplied to a washing spray nozzle 9 from a washing solution jetting pump 10 in a state where the print head 2 is press-contacted to a cap 5. The washing solution is sprayed onto a nozzle face 4 at the end of the print head 2 to wash the nozzle face 4.

After that, a usual restore operation is performed and printing is carried out to evaluate whether the nozzles are recovered from the clogging or not. The standard for the evaluation of recovery from the clogging is as follows:

○: All nozzles are recovered and no image defect is found.

Δ: All nozzles are recovered but slight image defects are found.

X: Some nozzles are not recovered and many image defects are found.

Example II-1

Using a washing device 11 in which a vessel 12 filled with a washing solution has inside wall 12*b*, an ink jet print head was washed.

A print head 14 removed from a printer is, as shown in FIG. 8B, disposed such that the surface of a nozzle 16 positioned at the end of the printer head 14 is dipped in washing solution and is kept as it is for 3 minutes and 10 minutes. Then the print head 14 is removed from the washing device. The washing solution in the nozzle 16 is removed by suction using a pump and the washing solution on the outside of the nozzle 16 is removed by wiping. Finally, ink is discharged from an ink tank while the printing machine is in an idle state, in order to complete the washing.

The amount of the washing solution used is 5 cc.

Figure 11:
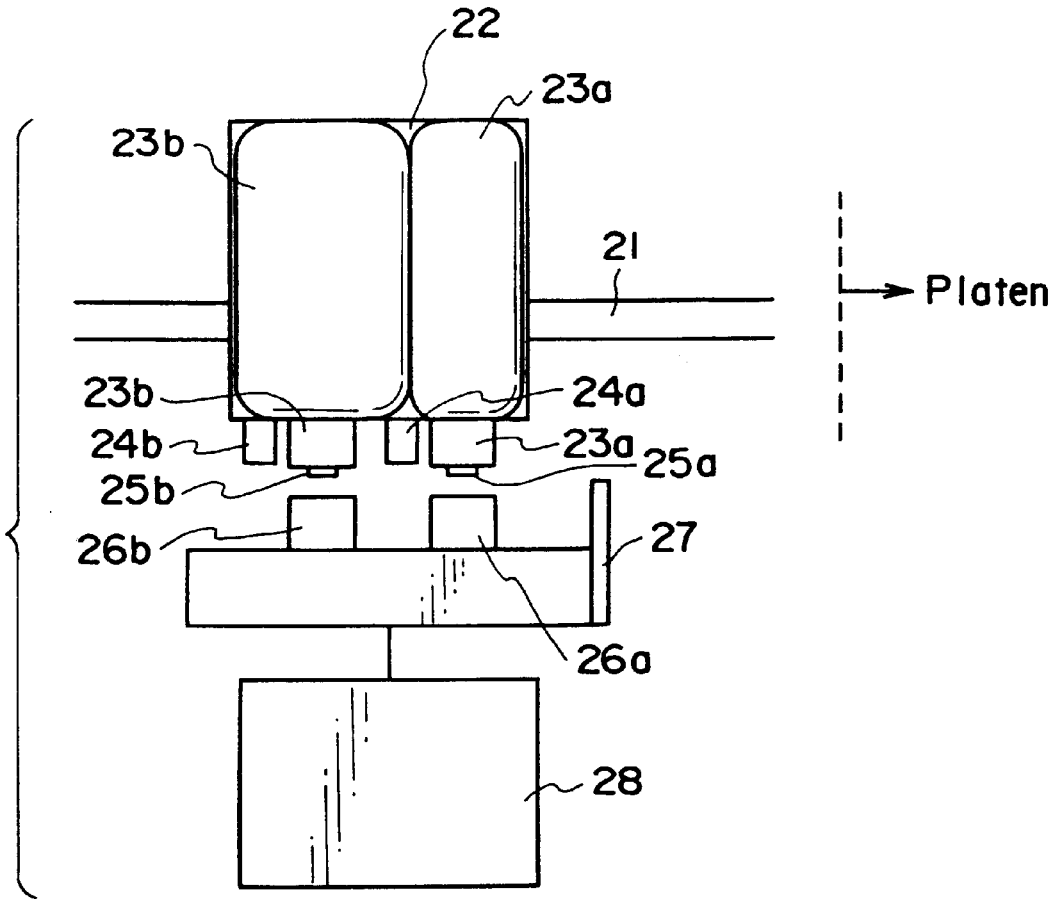
FIG. 11 is a typical view showing the structure of the ink jet printer equipped with a printer head washed in Example II.

The printer used for the evaluation is a trial product made by the inventors of the present invention. A typical view of this structure is shown in FIG. 11.

A carriage 22 is fitted with a head 23*a* for black and a head 23*b* for color, and wiper cleaners 24*a* and 24*b* for cleaning a blade 27 which wipes a nozzle face. Nozzle faces 25*a* and 25*b* having water-repellency are formed with 250 nozzles whose opening areas are each $2\times10^{-4}$ mm$^2$. The contact angle of an aqueous ink with the nozzle face is 87 degrees. A cap 26*a* for black and a cap 26*b* for color are disposed facing the corresponding head. These caps are press-contacted to the head to carry out a suction operation and to receive ink which is discharged while the printing machine is in an idle state.

Washing solutions used are as follows:

| Washing solution II-1 | |
|---|---|
| Ultra-pure water<br>Surface tension: 72 dyn/cm,<br>Viscosity: 0.89 mPas, pH: 6 | 100 wt % |

Example II-2

A print head 14 is washed in the same manner as in Example II-1 except that the following materials are used as the washing solution.

| Washing solution II-2 | |
|---|---|
| Ultra-pure water | 96.97 wt % |
| Isopropanol | 3.0 wt % |
| Nonionic surfactant (polyoxyethylenenonyl phenyl ether (30 mol adduct), manufactured by Nippon Oil and Fats)<br>Surface tension: 43 dyn/cm,<br>Viscosity: 1.5 mPas, pH: 4 | 0.03 wt % |

Example II-3

A print head 14 is washed in the same manner as in Example II-1 except that the following materials are used as the washing solution.

| Washing solution II-3 | |
|---|---|
| Washing solution II-2 | 92.0 wt % |
| Glycerin<br>pH: 8 adjusted by addition of a pH buffer<br>Surface tension: 43 dyn/cm,<br>Viscosity: 2.0 mPas | 8.0 wt % |

Example II-4

A print head 14 is washed in the same manner as in Example II-1 except that the one-bath type device shown in FIGS. 9A and 9B are used as the washing device and the following materials are used as the washing solution. The amount of the washing solution used is 10 cc.

| Washing solution II-4 | |
|---|---|
| Ultra-pure water<br>pH: 9 adjusted by addition of a pH buffer<br>Surface tension: 60 dyn/cm,<br>Viscosity: 1.2 mPas | 100 wt % |

Example II-5

A print head 14 is washed in the same manner as in Example II-1 except that, as the washing device, a type provided with a vessel equipped with a stirring blade as shown in FIGS. 10A and 10B are used.

The washing solution used is the same washing solution II-1 used in Example II-1. The amount of the washing solution used is 10 cc.

Comparative Example II-1

A print head is removed from a printer and washed by causing washing solution to flow down from the opening formed on the top of a nozzle face without dipping the print head in the washing solution. Then the nozzle face is suctioned by a pump and wiping and idle-discharging are carried out to remove the washing solution. The washing solution shown below is used. The amount of washing solution used is 10 cc.

| Washing solution II-3 | 100 wt % |
|---|---|

Comparative Example II-2

A print head is removed from a printer and washed by spraying washing solution onto the nozzle surface without dipping the print head in the washing solution. Then the nozzle face is suctioned by a pump and wiping and idle-discharging are carried out to remove the washing solution. The washing solution shown below is used. The amount of washing solution used is 5 cc.

Washing solution II-3 100 wt %

(Evaluation of Performance)

A head which could not print by the aid of a recovery device of a printer is washed by the above washing methods. The washed head is installed in a printer to evaluate the discharge capability and image defects.

The standard for the evaluation of printing is shown below.

Confirmation of Discharge Capability

○: All nozzles discharged.

Δ: Part of the nozzles do not discharge.

X: All nozzles do not discharge.

Image Defects

○: None.

ΔA: Slight defects occurs.

X: Occurs over the whole surface.

The results of the evaluation are shown in Table 3.

TABLE 3

| | Discharge capability | | Image defects | |
|---|---|---|---|---|
| Dipping time | 3 minutes | 10 minutes | 3 minutes | 10 minutes |
| Example II-1 | ○ | ○ | Δ | ○ |
| Example II-2 | Δ | ○ | Δ | ○ |
| Example II-3 | Δ | ○ | Δ | ○ |
| Example II-4 | ○ | ○ | ○ | ○ |
| Example II-5 | ○ | ○ | Δ | ○ |
| Comparative example II-1 | X | Δ | X | X |
| Comparative example II-2 | X | X | X | X |

As is clear from Table 3, the printers treated by the washing method of the present invention have good discharge capability and produce no image defects. This shows that good washing is achieved and the problem of clogging of the nozzle is solved. On the other hand, it is confirmed that the printers in Comparative Examples II-1 and II-2 which are washed in a method having no dipping step have low discharge capability showing that the washing is insufficient.

What is claimed is:

1. A method for washing an ink jet head, comprising:

a step of washing an ink jet head using an ink jet washing solution comprised of 80% by weight or more of water and 1.0% by weight or less of a substance with a viscosity of 10 mPas or more at 25° C. and/or of a substance which is a solid at 25° C., and wherein the washing solution has a viscosity between 0.6 and 3.0 mPas at 25° C. and an electroconductivity of $3\times10^{-5}$ S/m to $2\times10^{-4}$ S/m at 25° C., wherein microparticles with a size of 0.2 $\mu$m or more, if any, are present in the washing solution in a number not more than 100/ml; and a step of removing the solution inside the ink jet head after the washing.

2. The method according to claim 1, wherein the washing solution is supplied from a washing solution tank.

3. The method according to claim 1, wherein the ink jet comprises a head tank separable type print head unit in which a print head can be separated from an ink tank the ink tank being replaceable with a washing tank, thereby supplying the washing solution from the washing solution tank.

4. The method according to claim 2, wherein the washing solution tank has a washing solution support material therein.

5. The method according to claim 1, wherein a nozzle surface of the ink jet print head is ink-repellent and wherein the washing step comprises dipping the nozzle face of the print head in a washing solution having water as its major component.

6. The method according to claim 5, wherein the washing solution comprises 80% by weight or more of water and has a viscosity ranging from 0.7 to 5.0 mPas at 25° C., the viscosity (mPas) and surface tension (dynes/cm) of the washing solution satisfying the following formula (1):

$$\text{Surface tension/Viscosity} \geqq 10.$$

7. The method according to claim 5, wherein the washing solution comprises a surfactant.

8. The method according to claim 7, wherein the surfactant is a nonionic surfactant.

9. The method according to claim 5, wherein the washing solution comprises an aqueous organic solvent.

10. The method according to claim 9, wherein the aqueous organic solvent comprises one or more hydroxyl groups.

11. The method according to claim 5, further comprising a step of removing washing solution remaining unremoved in the print head after the step of dipping.

12. The method according to claim 5, further comprising a step of replacing washing solution remaining unremoved in the print head with an aqueous printing ink after the step of dipping.

13. The method according to claim 5, wherein an amount of washing solution used in the step of dipping satisfies the following formula (2):

$$(\text{Amount of washing solution (ml)})/(\text{Areas of opening of nozzle (mm}^2)\times\text{Number of nozzles}>16 \quad (2).$$

* * * * *